United States Patent [19]

Itsubo et al.

[11] Patent Number: 4,488,655

[45] Date of Patent: Dec. 18, 1984

[54] PLASTIC CLOSURE FOR CONTAINERS

[75] Inventors: Junichi Itsubo; Hiroyuki Oda, both of Hiratsuka, Japan

[73] Assignee: Japan Crown Cork Co., Ltd., Tokyo, Japan

[21] Appl. No.: 382,053

[22] Filed: May 25, 1982

[30] Foreign Application Priority Data

Mar. 15, 1982 [JP] Japan ..... 57-35209[U]

[51] Int. Cl.[3] ..... B65D 41/34

[52] U.S. Cl. ..... 215/252; 215/350

[58] Field of Search ..... 215/252, 350, 349

[56] References Cited

U.S. PATENT DOCUMENTS

| | | | |
|---|---|---|---|
| 1,910,913 | 5/1933 | Conner | 215/350 |
| 2,068,389 | 1/1937 | Smith | 215/350 |
| 3,189,209 | 6/1965 | Owens | 215/350 X |
| 3,944,103 | 3/1976 | Cros | 215/350 X |
| 4,153,174 | 5/1979 | Keeler | 215/252 |
| 4,196,818 | 4/1980 | Brownbill | 215/252 |
| 4,331,249 | 5/1982 | Banich | 215/352 |
| 4,418,828 | 12/1983 | Wilde et al. | 215/252 |

FOREIGN PATENT DOCUMENTS

| | | | |
|---|---|---|---|
| 8190 | 2/1980 | European Pat. Off. | 215/252 |
| 56-74445 | 6/1981 | Japan | 215/252 |
| 1054308 | 1/1967 | United Kingdom | 215/252 |

*Primary Examiner*—Donald F. Norton

*Attorney, Agent, or Firm*—Beveridge, DeGrandi and Kline

[57] ABSTRACT

A plastic closure having pilfer-proofing characteristics for a container including a mouth-neck portion having formed on its peripheral surface an external thread and an annular flange located beneath it. The closure includes a top panel wall and a cylindrical skirt wall extending downwardly from the peripheral edge of the top panel wall. A breakable line extending circumferentially is formed on the skirt wall to divide the skirt wall into a main portion above the breakable line and a pilfer-proof bottom portion below it, and an internal thread adapted to be fitted with the external thread of the mouth-neck portion of the container is formed on the inner surface of the main portion of the skirt wall. The inner surface of the pilfer-proof bottom portion has formed therein at least one flap extending radially inwardly therefrom.

7 Claims, 19 Drawing Figures

FIG. 4-A
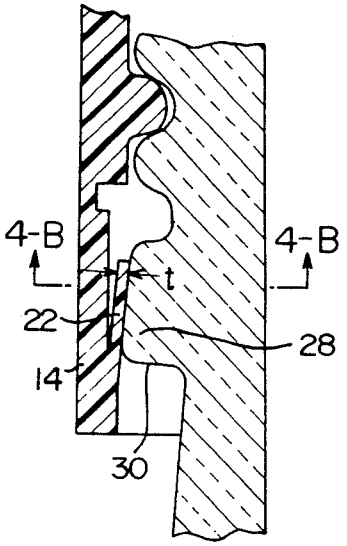
FIG. 5
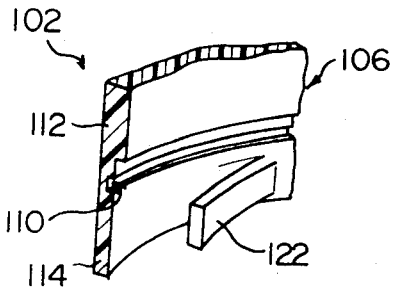
FIG. 4-B
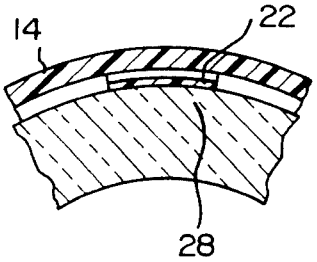
FIG. 6
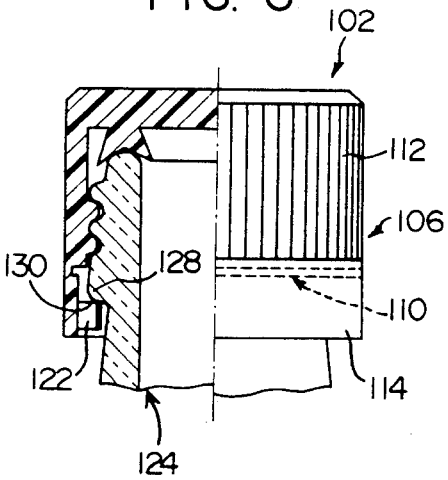

FIG. 8
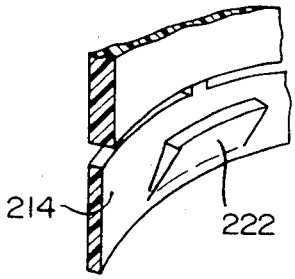
FIG. 9
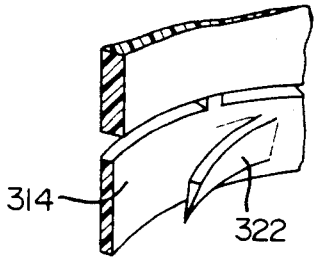
FIG. 10
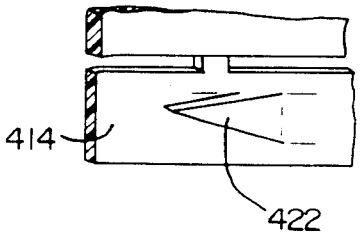
FIG. 7-A
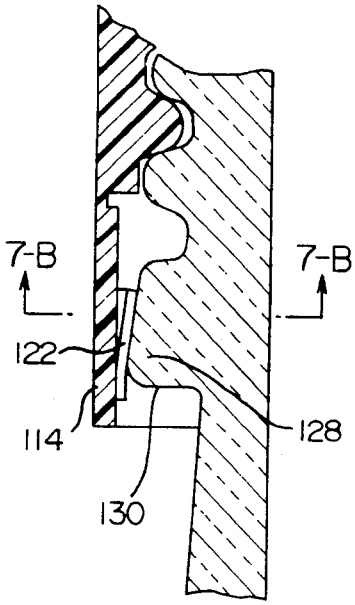
FIG. 7-B
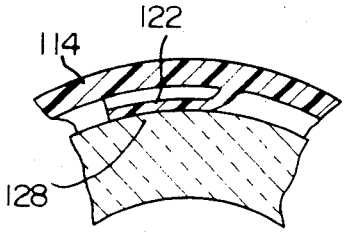

PLASTIC CLOSURE FOR CONTAINERS

FIELD OF THE INVENTION

This invention relates to a plastic closure for containers, and more specifically, to a plastic closure having a top panel wall and a cylindrical skirt wall extending downwardly from the peripheral edge of the top panel wall.

DESCRIPTION OF THE PRIOR ART

Metallic closures made of a metallic material such as an aluminum-base alloy have been in widespread use as closures of containers such as bottles for liquors and beverages. The recent tendencey is that these metallic container closures have been superseded by plastic closures made of suitable plastic materials.

Japanese Laid-Open Patent Publication No. 83588/1979 discloses a plastic closure having pilfer-proofing characteristics(designed to prevent unfair activities such as pilferage and exchanging of the contents). This type of container closure has a top panel wall and a cylindrical skirt wall extending downwardly from the peripheral edge of the top panel wall. A breakable line extending circumferentially is formed in the skirt wall to divide it into a main portion above the breakable line and a pilfer-proof bottom portion below the breakable line. An internal thread is formed on the inner surface of the main portion of the skirt wall. The pilfer-proof bottom portion of the skirt wall is stamped at a plurality of positions spaced from each other circumferentially to form tongue-like pieces protruding radially inwardly and axially upwardly.

This type of closure is applied to a container with a mouth-neck portion in an ordinary form having an external thread on its peripheral surface and an annular flange located beneath the external thread. In mounting the closure on the mouth-neck portion of the container and sealing it, the closure is put over the mouth-neck portion and turned until the internal thread formed on the inner surface of the main portion of the skirt wall is fitted with the external thread formed on the peripheral surface of the mouth-neck portion of the container. At this time, the tongue-like pieces formed in the pilfer-proof bottom portion of the skirt wall are elastically bent radially outwardly by the action of the annular flange formed on the peripheral surface of the mouth-neck portion. Consequently, the tongue-like pieces pass over the annular flange and engage the lower surface of the annular flange by elastically returning to their original state. To remove the closure from the mouth-neck portion of the container, it is turned in a direction reverse to that in mounting it. This turning movement causes the internal thread of the closure to move along the external thread of the mouth-neck portion of the container. Hence, as soon as the closure is turned, it tends to move axially upwardly. However, the tongue-like pieces formed in the pilfer-proof bottom portion of the skirt wall resist the axially upward movement of the closure because they are kept in engagement with the annular flange formed on the peripheral surface of the mouth-neck portion of the container. As a result, a considerable force is exerted on the breakable line formed in the skirt wall to break the skirt wall along the breakable line. After this, the closure, or more specifically its top panel wall and the main portion of its skirt wall, can easily move axially upwardly and be removed from the mouth portion of the container.

The known pilfer-proof plastic closure described above, however, has the following problems to be solved.

(a) After a suitable plastic molding step such as injection molding, the pilfer-proof bottom portion must be stamped in order to form the tongue-like pieces. Hence, the production of such closures is relatively complex and expensive.

(b) As a result of forming the tongue-like pieces by stamping, a plurality of relatively large openings corresponding to the tongue-like pieces are formed in the pilfer-proof bottom portion. Dust or other foreign matter is likely to gather in these openings to give rise to a sanitary problem.

(c) While the closure is mounted on the mouth-neck portion of the container, the tongue-like pieces could be displaced radially outwardly by, for example, inserting metallic wires through the above-mentioned openings and hooking up the tongue-like pieces with these wires. Accordingly, the closure could be removed from the mouth-neck portion of the container without breaking the breakable line, and the pilfer-proofing characteristics of the closure will be relatively easily impaired.

(d) The tongue-like pieces are formed by forcibly displacing a part of the pilfer-proof bottom portion radially inwardly in the stamping step, and after the completion of a step of molding a plastic, for example by injection molding, and before the stamping step, these tongue-like pieces do not protrude radially inwardly. Accordingly, when they are bent radially outwardly by the action of the annular flange in mounting the closure on the mouth-neck portion of the container, they tend to remain displaced radially outwardly without being sufficiently turned radially inwardly after they have passed over the annular flange. It is impossible therefore to insure sufficient pilfer-proofing characteristics.

In addition, conventional plastic closures also have the following problems. In a container closure having a top panel wall and a cylindrical skirt wall extending downwardly from the peripheral edge of the top panel wall, it is normally important to provide the inner surface of the top panel wall with a sealing member kept in intimate contact with the open end edge of the mouth of a container. The sealing member may be formed as an integral unit with the inner surface of the top panel wall. But frequently the main body of the closure having the top panel wall and the skirt wall and the sealing member are made of different plastic materials because it is generally desirable that the top panel wall and the skirt wall should be relatively rigid, whereas the sealing member should be relatively flexible in view of the need to seal the mouth-neck portion of the container fully.

In forming the main body of the closure and the sealing member from different plastic materials, it is the conventional practice to form the main body of the closure and the sealing member quite separately, and then insert the sealing member in the inner surface of the top panel wall of the closure. In inserting the sealing member in the inner surface of the top panel wall, the sealing member is bonded to the inner surface of the top panel wall through an adhesive interposed therebetween in order to prevent detachment of the sealing member from the inner surface of the top panel wall. Accordingly, the need to interpose an adhesive between the sealing member and the inner surface of the top panel wall makes the entire production process relatively complex. Another defect is that the adhesive so applied gives off an offensive smell which is likely to affect the flavor and taste of an article filled in the container.

In an attempt to remove these defects, the specification of Japanese Laid-Open Patent Publication No. 113651/1979 discloses a method which involves first forming the main body of the closure (or the sealing member), then forming the sealing member (or the main body of the closure) positioned in place with respect to the main body of the closure (or the sealing member), and forming, during the formation of the above parts, an engaged portion which engages both the main body of the closure and the sealing member thereby preventing the disengagement of both in the axial direction. In a plastic closure made by this method, the presence of an adhesive between the sealing member and the inner surface of the top panel of the closure is not necessary, and therefore, it is free from the above defects ascribable to the adhesive. Certainly, the axial disengagement of the main body of the closure from the sealing member can be prevented by the action of the engaged portion in the plastic closure disclosed in the above-cited Japanese patent document, by the engaged portion exercises no control over the relative rotation of the main body of the closure and the sealing member and they can rotate freely relative to each other. Therefore, while the closure is mounted on and seals the mouth-neck portion of a container, the sealing member is pressed against the open end edge of the mouth portion of the container fairly strongly and thus clings to it with a fairly great force. To open the container, the main body of the closure is rotated in the opening direction by holding the outside surface of the main body with fingers. When the main body of the closure and the sealing member can freely rotate relative to each other, the rotation of the main body of the closure in the opening direction does not result in the incidental rotation of the sealing member. The sealing member remains clinging to the open end edge of the mouth portion of the container, and tends to remain inseparable from the open end edge of the mouth-neck portion of the container until the main body of the closure is raised a considerable amount in the axial direction in response to the rotation of the main body of the closure and correspondingly the sealing member is raised a considerable amount in the axial direction. This tendency frequently causes undesirable incidents; for example, the opening of the mouth portion of the container is not fully and smoothly achieved, and an excessively large force is required for its opening.

SUMMARY OF THE INVENTION

A first object of this invention is to provide an improved plastic closure for containers, which has pilfer-proofing characteristics and gives a solution to the aforesaid problems (a) to (d) inherent to known pilfer-proof plastic closures.

A second object of this invention is to provide an improved plastic closure for containers, in which the main body of the closure and a sealing member are formed of different plastic materials, and the relative rotation of the main body of the closure and the sealing member can be accurately prevented without the need to use an adhesive, thereby overcoming the aforesaid defects or problems associated with conventional plastic closures.

To achieve the first object, the present invention provides a pilfer-proof plastic closure for a container with a mouth-neck portion having formed on its peripheral surface an external thread and an annular flange located beneath it, said plastic closure including a top panel wall and a cylindrical skirt wall extending downwardly from the peripheral edge of the top panel wall, said skirt wall having a breakable line extending circumferentially to divide it into a main portion above the breakable line and a pilfer-proof bottom portion below it, and the inner surface of said main portion having formed therein an internal thread adapted to be fitted with the external thread of the mouth-neck portion of the container, the inner surface of the pilfer-proof bottom portion having formed therein at least one flap extending therefrom radially inwardly, said flap being able to pass over the annular flange of the container by being elastically bent when mounting and closure on the mouth-neck portion of the container, and when the closure has been fully fitted with the mouth-neck portion of the container, the flap which has passed over the annular flange returning elastically to its original state and its upper edge engaging the lower surface of the annular flange.

To achieve the second object, the present invention provides a plastic closure for containers, comprising a main body having a top panel wall and a skirt wall extending downwardly from the peripheral edge of the top panel wall and a sealing member disposed on the inside surface of the top panel wall of the main body, said main body and the sealing member being formed of different plastic materials having different properties, and the inner surface of the top panel wall or the upper end portion of the inside surface of the skirt wall and the upper surface or circumferential side surface of the sealing member respectively having formed therein rotation-preventing engaging portions which are engaged with each other to prevent the relative rotation of the main body and the sealing member.

BRIEF DESCRIPTION OF THE DRAWINGS

FIG. 4-A is a partial, sectional view showing the behavior of a flap in mounting the closure of FIG. 1 on the mouth-neck portion of a container;

FIG. 4-B is a partial sectional view taken along line 4-B—4-B in FIG. 4-A;

FIG. 5 is a partial, perspective view of a second embodiment of the plastic closure constructed in accordance with this invention;

FIG. 6 is a side elevation, partly in section, of the closure of FIG. 5 as it is mounted on and seals the mouth-neck portion of a container;

FIG. 7-A is a partial, sectional view showing the behavior of a flap in mounting the closure of FIG. 5 on the mouth-neck portion of a container;

FIG. 7-B is a partial, sectional view taken along line 7-B—7-B in FIG. 7-A;

FIGS. 8, 9 and 10 are partial, perspective views showing modifications of the flap;

DETAILED DESCRIPTION OF THE PREFERRED EMBODIMENTS

Figure 1:
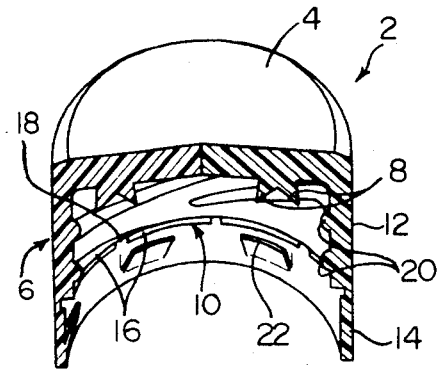
FIG. 1 is a partly broken-away perspective view of one embodiment of the plastic closure constructed in accordance with this invention.

One specific embodiment of the plastic container closure constructed in accordance with this invention is described with reference to FIGS. 1 and 2. The illustrated container closure shown generally at 2 is molded as a one-piece unit from a suitable plastic material such as polyethylene or polypropylene by a suitable method such as injection molding or press forming. The closure 2 has a circular top panel wall 4 and a cylindrical skirt wall 6 extending downwardly from the peripheral edge of the top panel wall 4. The inner surface of the top panel wall 4 has formed therein an annular sealing member 8 projecting downwardly therefrom as a one-piece unit. A circumferentially extending breakable line 10 is formed on the skirt wall 6 to divide the skirt wall 6 into a main portion 12 above the breakable line 10 and a pilfer-proof bottom portion 14 below the breakable line 10. The breakable line shown in the drawings consists of a plurality of circumferentially spaced slits 16 and "bridging portions" 18 located between the slits 16, and the pilfer-proof bottom portion 14 is connected to the main portion 12 by the bridging portions 18. An internal thread 20 is formed on the inner surface of the main portion 12 of the skirt wall 6, and the outside surface of the main portion 12 is knurled to enable the closure 2 to be surely and easily held and rotated with fingers.

The aforesaid construction of the closure 2 shown does not constitute the novel features of the closure of this invention, and is known per se.

According to this invention, one or more, preferably a plurality of, circumferentially spaced flaps 22 are formed on the inner surface of the pilfer-proof bottom portion 14 of the skirt wall 6. In the illustrated embodiment, six flaps 22 are formed circumferentially at equal intervals (only partly shown in the drawings). Each of the flaps 22 extends obliquely in an axially upward direction and a radially inward direction from its lower edge connected to the inner surface of the pilfer-proof bottom portion 14.

Now, with reference to FIGS. 2 and 3, one example of the mouth-neck portion of a container to which the closure 2 of the invention is to be applied will be described. The mouth-neck portion shown generally at 24 has formed on its peripheral surface an external thread 26 corresponding to the internal thread 20 formed in the closure 2, and adjacent to, and beneath, the external thread 26 is formed an annular flange 28 having an annular engaging surface 30 at its lower end. The mouth-neck portion 24 itself is in a usual form and is provided in containers widely distributed on the market. There is no need to produce it specially for the closure 2 of this invention.

Figure 2:
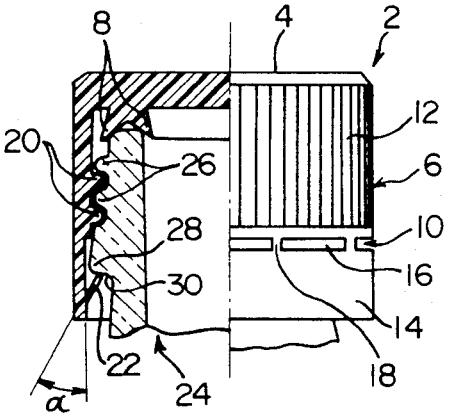
FIG. 2 is a side elevation, partly in section, of the closure shown in FIG. 1 as it is mounted on and seals the mouth-neck portion of a container.
Figure 3:
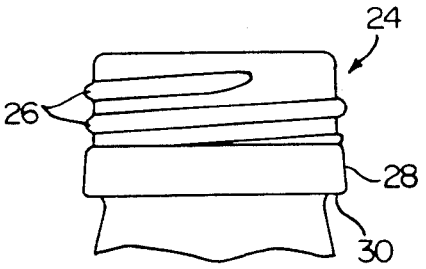
FIG. 3 is a side elevation of the mouth-neck portion of a container to which the closure shown in FIG. 1 is to be applied.

To seal the mouth-neck portion 24 shown in FIG. 3 by applying the closure 2 shown in FIG. 1, the closure 2 is fittingly put over the mouth-neck portion 24 and rotated in a clockwise direction as viewed from above in FIG. 2. This results in the fitting of the internal thread 20 of the closure 2 with the external thread 26 of the mouth-neck portion 24, and as a result, the closure 2 is moved axially downwardly as it rotates. When the closure 2 is moved downwardly, the flaps 22 formed in the closure 2 pass over the external thread 26 formed in the mouth-neck portion 24 and further go past the annular flange 28. At this time, as shown in FIGS. 4-A and 4-B, the flaps 22 undergo the action of the annular flange 28 and elastically bend radially outwardly with relative ease. Thus, as the closure 2 moves downwardly, the flaps 22 can pass over the annular flange 28. When internal thread 20 of the closure 2 has been fully fitted with the external thread 26 of the mouth-neck portion 24 and the closure 2 has been fully mounted on the mouth-neck portion 24 as shown in FIG. 3, the flaps 22 completely move past the annular flange 28 and no longer undergo the action of the annular flange and thus elastically return to their original state. As a result, the upper edges of the flaps 22 engage the lower surface of the annular flange 28, i.e. the annular engaging surface 30. In the meantime, the annular sealing member 8 formed on the inner surface of the top panel wall 4 of the closure 2 comes into engagement with the open edge of the mouth-neck portion 24 of the container, thus ensuring sealing of the mouth-neck portion 24.

To open the mouth-neck portion 24 of the sealed container by detaching the closure 2 from it, the closure 2 is rotated in a direction opposite to the rotating direction in the mounting operation, that is, in a counter-clockwise direction as viewed from above in FIG. 2. This rotating operation causes the internal thread 20 formed in the closure 2 to move along the external thread 26 formed in the mouth-neck portion 24 of the container, and the closure 2 tends to move axially upwardly. The axially upward movement of the closure 2, however, is hampered since the upper edges of the flaps 22 formed on the inner surface of the pilfer-proof bottom portion 14 of the closure 2 are kept in engagement with the lower surface of the annular flanges 28, or the annular engaging surface 30, of the mouth-neck portion 24. A considerable stress is therefore exerted on the breakable line 10 formed in the skirt wall 6, more specifically in its bridging portions 18 in the illustrated embodiment, to break the breakable line 10 (the bridging portions 18), whereby the closure 12 is separated into the pilfer-proof bottom portion 14 and the remaining portion (the top panel wall 4 and the main portion 12 of the skirt wall 6). After this, that part of the closure 2 which is other than the pilfer-proof bottom portion 14 can be easily moved axially upwardly, and therefore, as the closure 2 is rotated, this part moves axially upwardly and is removed from the mouth-neck portion 24. Thus, the container is opened. Meanwhile, the pilfer-proof bottom portion 14 remains undetached from the mouth-neck portion 24.

The closure 2 of the invention described hereinabove can be produced only by a suitable molding operation, for example, by injection molding or press forming, from a suitable plastic material such as polyethylene or polypropylene, and stamping of the molded article subsequent to the molding operation is not necessary. Hence, it can be produced simply at low cost.

Furthermore, when the closure 2 in accordance with this invention is fully mounted on the mouth-neck portion 24 of a container to seal it, the flaps 22 formed on the inner surface of the pilfer-proof bottom portion 14 bend elastically with sufficient ease in a radially outward direction under the action of the annular flange 28 formed in the mouth-neck portion 24, and go past the annular flange 28. Thus, according to this invention, the closure 2 can be relatively easily mounted on the mouth-neck portion 24 of the container to seal it. Since the mounting is relatively easy, the breakable line 10 is not likely to be broken at the time of mounting the closure 2. In addition, at a stage when the closure 2 has been produced by a molding operation such as injection molding or press forming, the flaps 22 already extend radially inwardly from the inner surface of the pilfer-proof bottom portion 14, and therefore, the flaps 22 are intrinsically of such a form as to extend radially inwardly from the inner surface of the pilfer-proof bottom portion 14. For this reason, when the closure 2 has been fully mounted on the mouth-neck portion 24 and the flaps 22 have moved past the annular flange 28, the flaps 22 elastically return to their original state with certainty, and the pilfer-proofing characteristics of the closure 2 can be insured. In order to meet fully the requirement that the flaps 22 should bend relatively easily at the time of mounting the closure 2 on the mouth-neck portion 24 of a container and after the closure 2 has been fully mounted on the mouth-neck portion 24, the upper edges of the flaps 22 should exactly engage the annular engaging surface 30 of the annular flange 28, it is preferred that each flap 22 should extend at an angle of about 5 to about 45 degrees with respect to the inner surface of the pilfer-proof bottom portion 14 (that is, the angle $\alpha$ in FIG. 2 being about 5 to about 45 degrees), and that the thickness t (see FIG. 4-A) of each flap 22 should be about 0.5 to about 3 mm, although these values slightly vary with the plastic material of which the closure 2 is made.

Furthermore, no opening exists in the pilfer-proof bottom portion 14 of the closure 2 of this invention, and as can be easily seen from FIG. 2, the flaps 22 are completely covered with the pilfer-proof bottom portion 14 when the closure 2 has been mounted on the mouth-neck portion 24. It is impossible therefore to displace the flaps 22 radially outwardly by manipulating them with metallic wires, etc. from outside. This means that the closure 2 cannot be removed from the mouth-neck portion 24 without breaking the breakable line 10, and the pilfer-proofing characteristics of the closure 2 can be insured.

A second embodiment of the plastic closure of the invention is shown in FIGS. 5 and 6. In a closure 102 shown in FIGS. 5 and 6, a breakable line 110 formed in a skirt wall 106 to divide it into a main portion 112 and a pilfer-proof bottom portion 114 is composed of a score formed by reducing the thickness of the material constituting the closure 102 as compared with the remaining portion of the closure 102 and extending continuously over the entire circumference of the skirt wall 106. One or more, preferably a plurality of, circumferentially spaced flaps 122 formed on the inner surface of the pilfer-proof bottom portion 114 extend not axially upwardly from the inner surface of the pilfer-proof bottom portion 114, but radially inwardly from their one side edges connected to the inner surface of the pilfer-proof bottom portion 114 in a direction opposite to the rotating direction of the closure 102 at the time of mounting the closure 102 on a mouth-neck portion 124 of a container (that is, in a counterclockwise direction as viewed from above in FIG. 6). Otherwise, the construction of the closure 102 shown in FIGS. 5 and 6 is substantially the same as that of the closure 2 shown in FIGS. 1 and 2.

Needless to say, it is apparent that the closure 102 shown in FIGS. 5 and 6 exhibits substantially the same operation and result as the closure 2 shown in FIGS. 1 and 2. When the closure 102 is mounted on the mouth-neck portion 124 of a container to seal it, the flaps 122 elastically bend relatively easily under the action of an annular flange 128 formed in the mouth-neck portion 124, and can move past the annular flange 128, as shown in FIGS. 7-A and 7-B. When the closure 102 has been fully mounted on the mouth-neck portion 124, the flaps 122 move past the annular flange 128 and thus are released from the action of the annular flange 128. As a result, they return elastically to their original state and their upper edges exactly engage the annular engaging surface 130 of the annular flange 128.

FIGS. 8 to 10 show modified examples of flaps formed on the inner surface of the pilfer-proof bottom portion.

A flap 222 shown in FIG. 8, like the flaps 22 of the closure 2 shown in FIGS. 1 and 2, extends axially upwardly and radially inwardly but is not of uniform thickness. Its thickness progressively increases from its lower edge toward its upper edge.

A flap 322 shown in FIG. 9, like the flap 122 of the closure 102 shown in FIGS. 5 and 6, extends radially inwardly from its one edge connected to the inner surface of a pilfer-proof bottom portion 314 in a direction opposite to the rotating direction of the closure at the time of mounting it on the mouth-neck porton of a container, but is not of uniform thickness. As in the flap 22 shown in FIG. 8, its thickness progressively increases from its lower edge toward its upper edge.

Preferably, the upper edges of the flap 222 shown in FIG. 8 and the flap 322 shown in FIG. 9 have a thickness of about 0.5 to about 3 mm in order to enable the upper edges of the flaps to be surely engaged with the jaw of the mouth-neck portion of a container and to surely maintain the pilfer-proofing characteristics of the closures.

A flap 422 shown in FIG. 10, like the flap 122 of the closure 102 shown in FIGS. 5 and 6, extends radially inwardly from its one side edge connected to the inner surface of a pilfer-proof bottom portion 414 in a direction opposite to the rotating direction of the closure at the time of mounting it on the mouth-neck portion of a container, but its shape is not rectangular. The upper edge of the flap 422 extends substantially horizontally, but its lower edge is inclined upwardly toward its free edge from its one side edge connected to the inner surface of the pilfer-proof bottom portion 414. Hence, the width of the flap 422 progressively decreases toward its free edge.

The flaps 222, 322 and 422 shown in FIGS. 8 to 10 can elastically bend more easily than the flaps 22 of the closure 2 shown in FIGS. 1 and 2 at the flaps 122 of the closure 102 shown in FIGS. 5 and 6.

Figure 11:
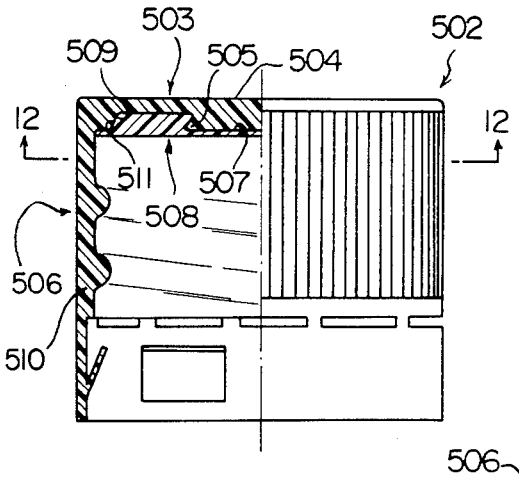
FIG. 11 is a side elevation, partly in section, of still another embodiment of the plastic closure constructed in accordance with this invention.
Figure 12:
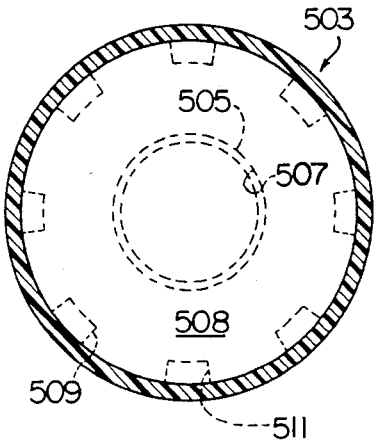
FIG. 12 is a sectional view taken along line 12—12 of FIG. 11.

FIGS. 11 and 12 show another embodiment of the plastic closure constructed in accordance with this invention. A closure shown generally at 502 is comprised of a main body 503 having a circular top panel wall 504 and a cylindrical skirt wall 506 extending downwardly from the peripheral edge of the top panel wall 504 and a sealing member 508 disposed on the inner surface of the top panel wall 504 of the main body 503. The main body 503 and the sealing member 508 are made of different plastic materials having different properties. Conveniently, the main body 503 is formed of a relatively rigid plastic material such as polypropylene or polyethylene, and the sealing member 508 is made of a relatively flexible plastic material such as polyvinyl chloride or an ethylene/vinyl acetate copolymer.

The closure 502 of the above type can be conveniently produced by first forming the main body 503 by a suitable molding operation such as injection molding or press forming, and then forming the sealing member 508 directly at a predetermined site of the main body 503 by a suitable molding operation such as injection molding or press forming. Or it can also be conveniently produced by first forming the sealing member 508 by a suitable method and then forming the main body 503 by a suitable method in proper relation to the sealing member 508.

A downwardly extending projection 505 is centrally formed as a one-piece unit on the inner surface of the top panel wall 504 of the main body 502. As can be easily seen from FIGS. 11 and 12, the projection 505 is frustoconical with its outside diameter progressively increasing downwardly. A depression 507 having a shape conforming to the projection 505 and engaging the projection 505 is formed centrally on the upper surface of the sealing member 508 which is substantially disk-like as a whole. It will be appreciated from FIG. 11 that in the illustrated embodiment, the detachment of the main body 503 and the sealing member 508 in the axial direction (in the vertical direction) is surely prevented by the action of an engaged portion comprised of the projection 505 and the depression 507. If desired, the depression 507 may be caused to extend to the lower surface of the sealing member 508 so that the projection 505 formed centrally on the inner surface of the top panel wall 504 of the main body 503 extends through the sealing member 508 via the depression 507. If further desired, it is possible, contrary to the illustrated embodiment, to form an upwardly extending projection centrally on the upper surface of the sealing member 508 and a corresponding depression centrally on the inner surface of the top panel wall 504 of the main body 503.

It is also important that in the illustrated closure constructed in accordance with this invention, rotation-preventing engaging portions should be formed for preventing the relative rotation of the main body 503 and the sealing member 508. With reference to FIG. 12 taken together with FIG. 11, a plurality of (8 in the drawings) circumferentially spaced raised portions 509 which project radially inwardly and axially downwardly are provided in a boundary area between the peripheral edge of the inner surface of the top panel 504 and the upper end of the inner surface of the skirt wall 506. Correspondingly to the raised portions 509, a plurality of (8 in the drawings) depressed portions 511 having a shape corresponding to the raised portions 509 and engaging the raised portions 509 are formed at circumferentially spaced intervals in a boundary area between the peripheral edge of the upper surface of the sealing member 508 and the upper end of the peripheral side surface of the sealing member 508. The raised portions 509 and the depressed portion 511 kept in engagement with each other form a rotation-preventing engaging portion, and as will be easily appreciated from FIGS. 11 and 12, surely prevent the relative rotation of the main body 503 and the sealing member 508. Of course, the same operation and result can be obtained by forming a plurality of depressed portions on the main body 503 and a plurality of raised portions on the sealing member 508.

Figure 15:
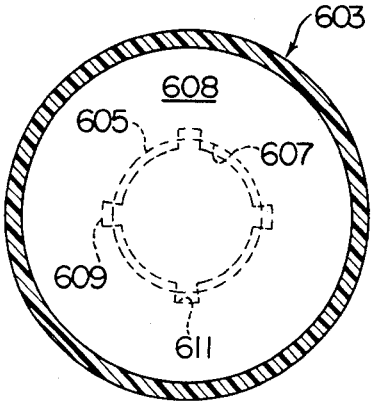
FIGS. 15 and 17 are sectional views taken on line 15—15 of FIG. 14 and lin 17—17 of FIG. 16, respectively.

Except the elements described hereinabove, the construction of the closure 502 shown in FIGS. 11 and 15 is substantially the same as that of the closure 2 shown in FIGS. 1 and 2, and therefore, a detailed description of it will be omitted in this specification.

The closure 502 shown in FIGS. 11 and 12 can also be applied to the mouth-neck portion 24 of a container shown in FIG. 3. When the closure 502 is mounted in position on the mouth-neck portion 24 by the same method as in the case of the closure 2, the sealing member 508 disposed on the inner surface of the top panel wall 504 of the main body 503 is pressed against the open edge of the mouth-neck portion 24 and clings firmly to it, thereby surely sealing the mouth-neck portion 24.

Figure 13:
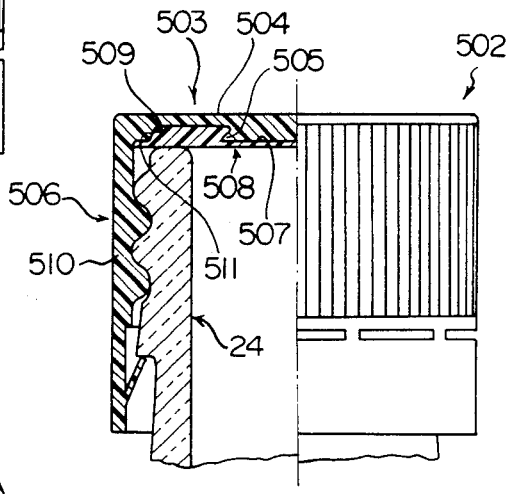
FIG. 13 is a side elevation, partly in section, of the closure shown in FIG. 11 as it is mounted on the mouth-neck portion of a container.

In removing the closure 502 from the mouth-neck portion 24, the main portion 503 is rotated in the same way as in the case of the closure 2 shown in FIGS. 1 and 2 in the opening direction (i.e., in a counterclockwise direction as viewed from above in FIG. 13) by manipulating the outside surface of the main portion 510 of the skirt wall 506 with fingers. As a result, the sealing member 508 is surely rotated in the opening direction following the rotation of the main body 503 since the relative rotation of the main body 503 and the sealing member 508 is surely prevented by the action of the rotation-preventing engaging portion comprised of the raised portions 509 and the depressed portions 511. This rotation enables the sealing member 508 to be surely separated from the open edge of the mouth-neck portion 24 to which it has clung.

Figure 14:
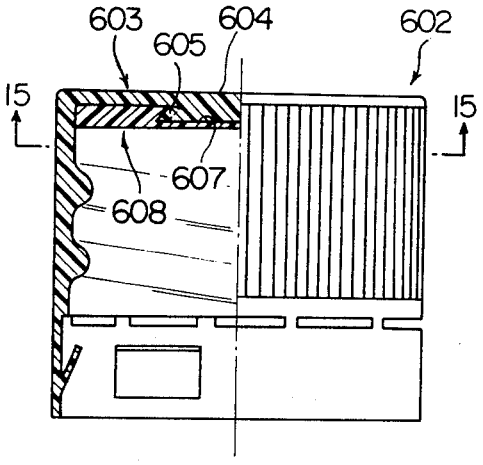
FIGS. 14 and 16 are side elevations, partly in section, of modifications of rotation-preventing engaging portions provided respectively in the main body of a container closure and a sealing member.

FIGS. 14 and 15 show another embodiment of the closure of this invention in which a sealing member 608 and a main body 603 of the closure are formed of different plastic materials. In the closure 602 shown in FIGS. 14 and 15, a plurality of radially outwardly projecting raised portions 609 are formed at circumferentially spaced intervals on the peripheral side surface of a projection 605 formed centrally on the inner surface of a top panel wall 604 of the main body 603. A plurality of depressed portions 611 having a shape conforming to the raised portions 609 and engaging the raised portions 609 are formed on the inner circumferential surface of a depression 607 formed centrally on the upper surface of the sealing member 608. The raised portions 609 and the depressed portions 611 constitute a rotation-preventing engaging portion for surely preventing the relative rotation of the main body 603 and the sealing member 608. Except as noted above, the construction of the closure 602 shown in FIGS. 14 and 15 is substantially the same as that of the closure 502 shown in FIGS. 11 and 12.

Figure 16:
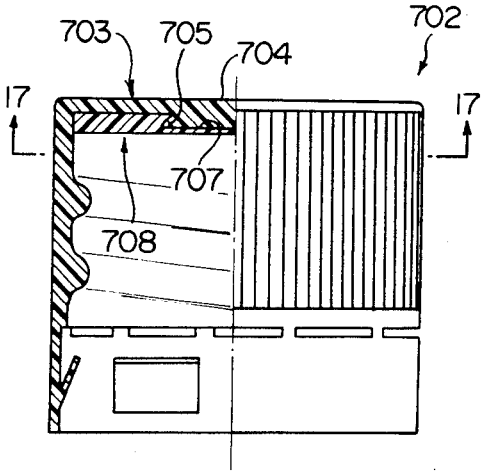
Figure 17:
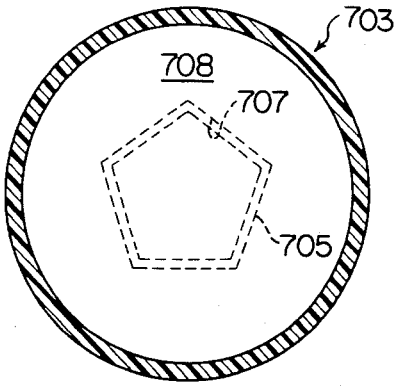

FIGS. 16 and 17 show still another embodiment of the closure of this invention in which a sealing member 708 is made of a plastic material which is different from the plastic material from which a main body 703 of a closure 702 is formed. In the closure 702 shown in FIGS. 16 and 17, a projection 705 formed centrally on the inner surface of a top panel wall 704 of the main body 703 is of a polygonal pyramid having a polygonal (in the drawings, regular pentagonal) cross section with its cross sectional area gradually increasing toward its bottom. A depression 707 formed centrally on the upper surface of the sealing member 708 is also of the shape of a polygonal pyramid corresponding to the shape of the projection 705. In this closure 702, the engagement of the projection 705 with the depression 707 surely prevents the axial detachment of the main body 703 and the sealing member 708 and also the relative rotation of the main body 703 and the sealing member 708. In other words, the projection 705 and the depression 707 engaged with each other in the closure 702 shown in FIGS. 16 and 17 constitute both an engaged portion for preventing the axial detachment of the main body 703 and the sealing member 708 and a rotation-preventing engaging portion for preventing the relative rotation of the main body 703 and the sealing member 708. Except as described above, the construction of the closure 702 illustrated in FIGS. 16 and 17 is substantially the same as that of the closure 502 shown in FIGS. 11 and 12.

It is to be understood that the rotation-preventing engaging portion provided in the main body of the closure and the sealing member as described with reference to FIGS. 11 to 17 in closures of the type in which the main body and the sealing member are formed of different plastic materials having different properties is applicable not only to closures of the specified forms illustrated in the drawings and having pilfer-proofing characteristics, but also to closures of other forms having pilfer-proofing characteristics and closures of various forms having no pilfer-proofing characteristics.

While the plastic closure constructed in accordance with this invention has been described in detail with reference to some specific embodiments shown in the accompanying drawings, it should be understood that the present invention is not limited to these specified embodiments, and various changes and modifications are possible without departing from the scope of the invention.

What we claim is:

1. For use in a container including a mouth-neck portion having formed on its peripheral surface an external thread and an annular flange located beneath it, a pilfer-proof plastic closure comprising a top panel wall and a cylindrical skirt wall extending downwardly from the peripheral edge of the top panel wall, said skirt wall having a breakable line extending circumferentially to divide it into a main portion above the breakable line and a pilfer-proof bottom portion below it, and the inner surface of said main portion having formed therein an internal thread adapted to be fitted with the external thread of the mouth-neck portion of the container, the inner surface of the pilfer-proof bottom portion having connected thereto at least one flap extending therefrom radially inwardly, said flap being able to pass over the annular flange of the container by being elastically bent when mounting the closure on the mouth-neck portion of the container, and when the closure has been fully fitted with the mouth-neck portion of the container, the flap which has passed over the annular flange returning elastically to its original state and its upper edge engaging the lower surface of the annular flange, said flap increasing progressively in thickness from its lower edge to its upper edge, and the thickness of its upper edge is about 0.5 to about 3 mm.

2. The closure of claim 1 wherein the flap extends axially upwardly from its lower edge connected to the inner surface of the pilfer-proof bottom portion.

3. The closure of claim 1 wherein the flap extends from its one side edge connected to the inner surface of the pilfer-proof bottom portion in a direction opposite to the rotating direction of the closure when mounting it on the mouth-neck portion.

4. The closure of any one of claims 1 to 3 wherein the flap is rectangular.

5. The closure of claim 1 wherein the flap extends at an angle of about 5 to about 45 degrees with respect to the inner surface of the pilfer-proof bottom portion.

6. A plastic closure for containers, comprising a main body having a top panel wall and a skirt wall extending downwardly from the peripheral edge of the top panel wall, and a sealing member disposed on the inside surface of the top panel wall of the main body, said main body and said sealing member being formed of different plastic materials having different properties, said main body having a central area located centrally in the inner wall of the top panel wall, said sealing member having a central area located centrally in its upper surface, one of said central areas comprising a projection means, and the other of said central areas comprising a depression means which receives said projection means, one of said means having a side surface provided with a plurality of circumferentially spaced apart raised portions extending outwardly therefrom, the other of said means having a side surface provided with a plurality of circumferentially spaced apart depressed portions which extend inwardly therefrom, said depressed portions engaging said raised portions to prevent the relative rotation of the main body and the sealing member.

7. For use in a container including a mouth-neck portion having formed on its peripheral surface an external thread and an annular flange located beneath it, a pilfer-proof plastic closure comprising a top panel wall and a cylindrical skirt wall extending downwardly from the peripheral edge of the top panel wall, said skirt wall having a breakable line extending circumferentially to divide it into a main portion above the breakable line and a pilfer-proof bottom portion below it, and the inner surface of said main portion having formed therein an internal thread adapted to be fitted with the external thread of the mouth-neck portion of the container, the inner surface of the pilfer-proof bottom portion having connected thereto at least one flap extending therefrom radially inwardly, said flap being able to pass over the annular flange of the container by being elastically bent when mounting the closure on the mouth-neck portion of the container, and when the closure has been fully fitted with the mouth-neck portion of the container, the flap which has passed over the annular flange returning elastically to its original state and its upper edge engaging the lower surface of the annular flange, a sealing member disposed on the inner surface of the top panel wall of the main body of the closure, said sealing member being made of a plastic material having properties which are different from those of the main body of the closure, raised and depressed rotation-preventing engaging portions which are engaged with each other to prevent the relative rotation of the main body of the closure and the sealing member, said main body having a central area located centrally in the inner wall of the top panel wall, said sealing member having a central area located centrally in its upper surface, one of said central areas having a projection means therein, and the other of said central areas having a depression means therein which receives said projection means, one of said means having a circumferential area provided with a plurality of said raised portions which are spaced apart, the other of said means having a circumferential area provided with a plurality of said depressed portions which are spaced apart and are engaged with said raised portions to prevent the relative rotation of the main body of the closure and the sealing member.

* * * * *